US005918499A

United States Patent [19]

Langlasse et al.

[11] Patent Number: 5,918,499

[45] Date of Patent: Jul. 6, 1999

[54] RIVET FORMATION

[75] Inventors: Jean Langlasse, Arnouville-les-Gonesses; Jean Mevel, Nantes; Jean-Francois Devaud, Meudon, all of France

[73] Assignee: CarnaudMetalbox (Holdings) Inc., Wilmington, Del.

[21] Appl. No.: 08/952,776

[22] PCT Filed: May 17, 1996

[86] PCT No.: PCT/GB96/01182

§ 371 Date: Jan. 6, 1998

§ 102(e) Date: Jan. 6, 1998

[87] PCT Pub. No.: WO96/36447

PCT Pub. Date: Nov. 21, 1996

[30] Foreign Application Priority Data

May 19, 1995 [FR] France ..... 95/05975

[51] Int. Cl.[6] ..... B21D 51/38

[52] U.S. Cl. ..... 72/356; 72/379.2; 413/14

[58] Field of Search ..... 29/509; 72/356, 72/348, 379.2; 413/14, 16

[56] References Cited

U.S. PATENT DOCUMENTS

| | | | |
|---|---|---|---|
| 3,191,564 | 6/1965 | Fraze | 413/14 |
| 3,638,597 | 2/1972 | Brown | 29/509 |
| 4,783,985 | 11/1988 | LeBarge et al. | 72/379.2 |

FOREIGN PATENT DOCUMENTS 2660220 4/1990 France .

*Primary Examiner*—Lowell A. Larson
*Attorney, Agent, or Firm*—Diller, Ramik & Wight, PC

[57] ABSTRACT

A process of forming a rivet from a sheet of metal, typically double reduced steel, by producing a blister surrounded by an annular configuration in a first operation or first stage. A second operation or second stage forms the blister into a boss by flattening the annular corrugation between a die and a support so as to push metal back toward the center of the blister. Finally, the boss is converted into an upstanding hollow rivet.

11 Claims, 1 Drawing Sheet

RIVET FORMATION

BACKGROUND OF THE INVENTION

This invention relates to a process for forming a rivet. In particular, it relates to a process for forming a rivet in a thin metal sheet such as is used, for example for a metal container end to which a tab or ring pull is to be fixed, typically a so-called "easy open end".

It is a particular aim of this invention to provide a process which is suitable for high production rates. It is further desirable to enable rivets of small diameter to be formed in hard materials which are not very malleable such as double reduced steel. The use of double reduced steel is becoming increasingly popular in the metal packaging industry.

A process for forming a hollow rivet is described in FR-2660220 (EP-0451013). In that document, two operations are used to form the rivet. Firstly, a completely circular boss is formed by drawing the metal in a punch, the boss having annular corrugations. The rivet is then formed from this boss and having the same centre as the boss.

This process results in considerable necking of the metal in the region of the corrugations. The main force is exerted in the central part, which can lead to excessive and badly controlled thinning of the metal. This is particularly the case during the second stage, when the corrugations are ironed until they completely disappear. This consequently increases the risk of breaking off the rivet when the rivet is staked or flattened for securing a tab onto a container end. Moreover, the metal blanks are generally lacquered prior to rivet formation, so that the process frequently results in damage to this coating. Finally, the punch operation must be fairly slow to avoid splitting of the metal.

As a result of these problems, the process of FR-2660220 is in practice only suitable for use with very malleable metals, such as aluminium. This process is therefore incompatible with high production rates, unsuitable for the formation of rivets of small diameter, and difficult to use with high carbon steel sheet, such as double reduced steel.

The present invention seeks to overcome the above problems.

SUMMARY OF THE INVENTION

According to the present invention, there is provided a process for making a rivet in a thin metal sheet for a metal container end, comprising forming a boss from the sheet metal and then converting the boss into an upstanding hollow rivet; characterised by the process comprising at least two operations to form a boss, the operations including:

deforming the metal into a blister, by drawing the metal into a substantially circular configuration and creating at least one annular corrugation; and converting the blister into the boss by clamping the metal sheet outside the corrugation; and flattening the corrugation to push metal back towards the centre.

Advantageously, during the transformation of the blister into the boss, the sheet is clamped gently outside the corrugation so as to allow sliding of the metal during the flattening of the corrugation. This limits thinning of the metal and avoids damage to any coating.

A preferred embodiment of the invention will now be described, by way of example only, with reference to the drawings, in which:

DESCRIPTION OF THE PREFERRED EMBODIMENTS

Figure 1A:
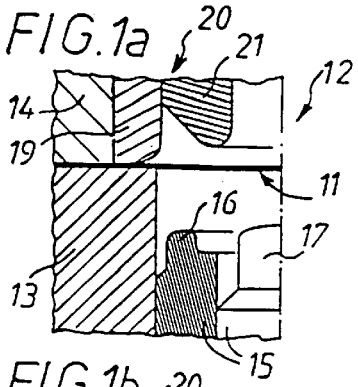
FIGS. 1*a* to 1*e* are half side sections of a first station for forming a blister.
Figure 1B:
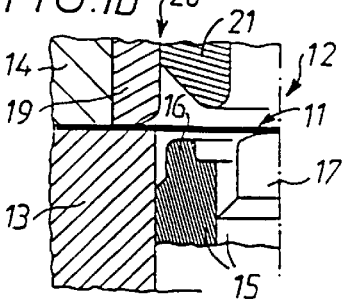
Figure 1C:
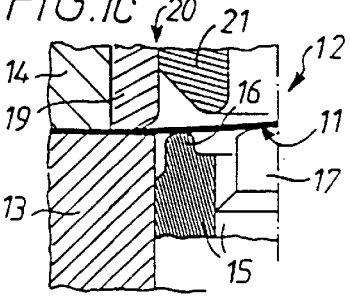

Referring first to figure 1*a* to 1*c*, there is shown a blank of thin sheet metal 11, typically of double reduced steel, for subsequent conversion into an easy open end for a metal container. This blank is advantageously prelacquered and/or decorated.

An easy open end is provided with a conventional tab or ring pull (not shown) which is fixed to the end by riveting. The present invention concerns the formation of the rivet in the blank (FIG. 4) by successive operations on a transfer press.

Figure 1D:
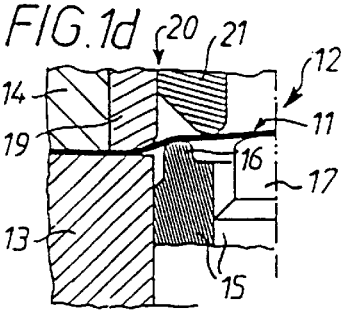
Figure 1E:
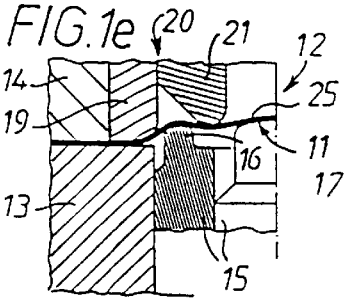

The first station 12 of the transfer press comprises a clamping member 14 which is axially movable so as to clamp the blank on a flat upper face of an annular support 13. A punch 15, comprising two coaxial parts, a ring 16 and a central element 17, is positioned inside the support 13. The ring 16 and the central element 17 are firmly connected. The upper extremity of the central element 17, which is in the form of a dome, is slightly offset axially relative to the upper extremity of the ring 16, so that the dome is the first to contact the sheet metal blank 11 during the downstroke of the clamping member 14, which ends with the formation of the blister 25 (FIG. 1*e*).

A die 20, fixed inside the clamping member 14, comprises an outer ring 19 and an inner ring 21. For clamping the blank, the outer ring 19 co-operates with the upper face of the annular support 13. The rings 19 and 21 are firmly connected. The lower extremity of the ring 21 is offset axially and is set back from the lower extremity of the ring 19 so that ring 21 only enters into contact with the blank at the last part of the stroke of the clamping member 14.

The inner edge of the ring 19, the extremities of the rings 16 and 21 and the edge of the dome of the central element 17 are rounded and have radii of curvature chosen as a function of the desired shape of the blank and the characteristics of the sheet metal used. The determination of these radii of curvature is within the capacity of the man skilled in the art. The clamping of the blank between the ring 19 and the support 13 is strong so as to prevent any sliding of the sheet metal during the formation of the blister 25.

In FIGS. 2*a* to 2*e*, the blank 11 in which the blister 25 has been formed is shown positioned on a second deformation station 28 of the press. This second station comprises another elastically mounted support 30 inside which is a punch 32. An upper holding block 34 is axially movable to hold the blank 11 against a flat upper face of support 30. A pressure ring 36 is axially movable and is mounted around die 35. Ring 36 is biased, for example by springs (not shown), towards the flat upper face of the support 30, in order to hold the blank there during the downstroke of the upper holding block 34.

The pressure ring 36 contacts the blank 11 outside the blister 25. The blank is held only moderately firmly so that some sliding of the metal during the conversion of the blister into the boss is possible at this second station.

According to an important characteristic of this invention, the inner radial part of the die 35 rests in the outer zone of the blister.

As the various parts of the second station move towards each other, it can be seen from FIG. 2 that the upper holding block 34 and the die 35 descend towards the support 30 before the punch 32 enters into contact with the central part of the blister. The pressure ring 36 is the first to contact the blank. The inner edge of the die 35 is rounded, as is the outer edge of the punch 32.

Figure 3:
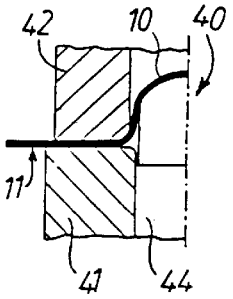
FIGS. 3 and 4 are half side sections of third and fourth stations respectively for conversion of the boss into a rivet.

The last two stations (FIGS. 3 and 4 respectively) are conventional. In FIG. 3, the third station 40 comprises a fixed lower support 41 and a die 42. A punch 44 is fixed inside the fixed support 41. The inner and outer diameters of the die 42 and of the punch 44 are different so that the boss is converted into an upstanding rivet without unacceptable necking. The inside edge of the die 42 and, most importantly, the punch 44 are rounded.

Figure 4:
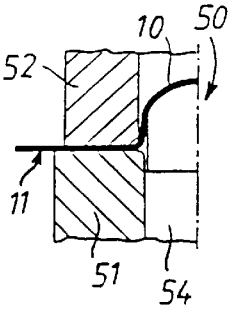

In FIG. 4, the station 50 likewise comprises a fixed lower support 51 and a die 52. A punch 54 is fixed inside the fixed support 51. This allows the rivet formed at the previous station to be calibrated.

The process for forming a rivet is as follows. The blank 11 for an easy open end is mounted on the elastically mounted support 13 of the first station 12 and the clamping member 14 is lowered until the blank is firmly held outside the zone to be deformed (hereinafter referred to as "the zone") as shown in FIG. 1*a*. The held blank is then lowered into contact with the central part of the punch 17 to deform the most central part of the said zone (FIG. 1*b*). The ring 16 then contacts the peripheral part of said zone (FIG. 1*c*) and pushes the metal upwards (FIG. 1*d*) until the blister contacts the lower extremity of the inner ring 21 of die 20. At the end of the downstroke of the upper die, an annular corrugation 39 is formed (FIG. 1*e*). The blister 25 is then complete and has a circular configuration, concentric with the annular corrugation 39. The last two stages shown in FIGS. 1*d* and 1*e* are accompanied by a moderate and controlled thinning of the metal in the vicinity of the zone.

The blank formed with the blister is transferred to the second deformation station 28 and placed on the flat upper surface of the support 30. The actuation of the upper holding block 34, which is lowered onto the blank, results in a moderate clamping of the blank by pressure ring 36 all around the zone to be deformed (FIG. 2*a*).

Figure 2A:
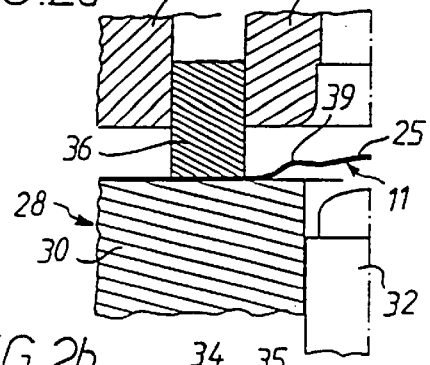
FIGS. 2*a* to 2*e* are half sections of a second station for forming a boss from the blister of figure le.
Figure 2B:
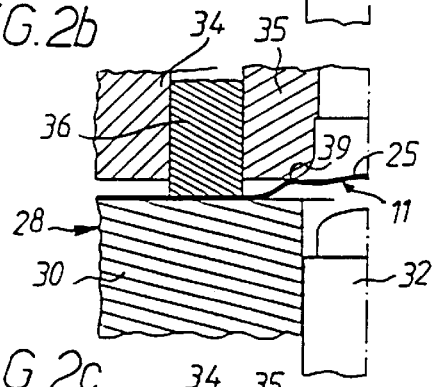
Figure 2C:
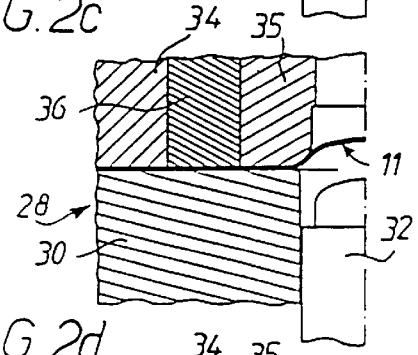

In the position of FIG. 2*a*, it should be noted that the annular corrugation 39 is placed between the die 35 and the support 30, radially inside die 35. As the die is lowered further (FIG. 2*b*) the annular corrugation 39 is flattened out until it completely disappears (FIG. 2*c*). The result of this flattening is to "push back" the metal towards the centre of the zone.

Figure 2D:
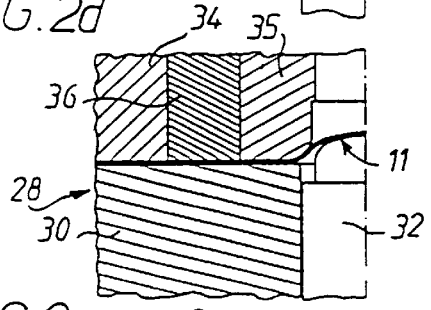
Figure 2E:
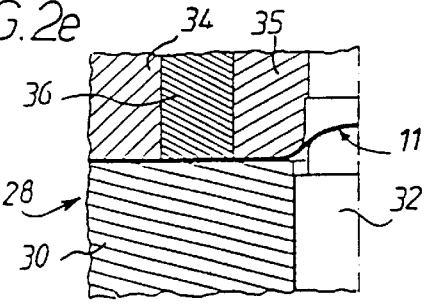

Further descent of the die brings the partially formed boss into contact with the punch 32 (FIG. 2*d*). This pushes back the metal until the desired boss is obtained (FIG. 2*e*).

The last two stages of forming the rivet are shown in FIGS. 3 and 4. These are conventional and are not described in detail here. Essentially, they comprise progressive conversion of the boss into a rivet 10 with an upstanding wall, as shown in FIG. 4.

Although a preferred embodiment of the invention has been specifically illustrated and described herein, it is to be understood that minor variations may be made in the apparatus without departing from the spirit and scope of the invention, as defined the appended claims.

We claim:

1. A process of making a rivet in a thin metal sheet for a metal container end comprising the steps of:

clamping the metal sheet, deforming a portion of the metal sheet into a blister by drawing an unclamped portion of the metal sheet into a substantially circular configuration, thereafter creating at least one annular corrugation substantially surrounding the circular blister by stretching an annular unclamped portion of the metal sheet outboard of the circular blister, converting the circular blister into a boss by clamping the metal sheet outside the annular corrugation before flattening the annular corrugation, flattening the unclamped annular corrugation by pushing metal radially inwardly toward a center of the blister to form the boss from the metal of the blister and the metal of the annular corrugation, and thereafter converting the boss into an upstanding rivet.

2. The process according to claim 1, characterised in that the rivet is formed in a prelacquered and/or decorated metal container end.

3. The process according to claim 2, characterised in that the metal is steel.

4. The process according to claim 2, characterised in that the metal is double reduced steel.

5. The process according to claim 2, in which the converting step comprises gently clamping (36) the circular blister (25) outside the annular corrugation (39); and allowing sliding of the metal during flattening of the annular corrugation (39).

6. The process according to claim 1, characterised in that the metal is steel.

7. The process according to claim 6, characterised in that the metal is double reduced steel.

8. The process according to claim 6, in which the converting step comprises gently clamping (36) the circular blister (25) outside the annular corrugation (39); and allowing sliding of the metal during flattening of the annular corrugation (39).

9. The process according to claims 1, characterised in that the metal is double reduced steel.

10. The process according to claim 9, in which the converting step comprises gently clamping (36) the circular blister (25) outside the annular corrugation (39); and allowing sliding of the metal during flattening of the annular corrugation (39).

11. The process according to claim 1, in which the converting step comprises gently clamping (36) the circular blister (25) outside the annular corrugation (39); and allowing sliding of the metal during flattening of the annular corrugation (39).

* * * * *